US006979273B2

(12) United States Patent
Tsai

(10) Patent No.: US 6,979,273 B2
(45) Date of Patent: Dec. 27, 2005

(54) ROTARY BASEBALL BATTING PRACTICE DEVICE

(76) Inventor: Peter Tsai, 9F., No. 196, Min-Sheng Rd., Hsinchu City (TW)

( * ) Notice: Subject to any disclaimer, the term of this patent is extended or adjusted under 35 U.S.C. 154(b) by 0 days.

(21) Appl. No.: 10/738,545

(22) Filed: Dec. 16, 2003

(65) Prior Publication Data

US 2005/0130771 A1 Jun. 16, 2005

(51) Int. Cl.[7] ..... A63B 69/00; A63B 71/00
(52) U.S. Cl. ..... 473/417; 473/422
(58) Field of Search ..... 473/422, 417–420, 473/431; D21/715, 780

(56) References Cited

U.S. PATENT DOCUMENTS 2,616,692 A * 11/1952 Bird ..... 473/417
3,139,282 A * 6/1964 Lande ..... 473/417
3,489,411 A * 1/1970 Morelli et al. ..... 473/417
4,664,374 A * 5/1987 Groves ..... 473/417
4,709,924 A * 12/1987 Wilson et al. ..... 473/417
4,796,885 A * 1/1989 Wright ..... 473/417
4,962,924 A * 10/1990 James ..... 473/417
5,004,234 A * 4/1991 Hollis ..... 473/417
5,320,343 A * 6/1994 McKinney ..... 473/417
5,388,823 A * 2/1995 Prieto ..... 473/417
5,556,091 A * 9/1996 Lin ..... 473/417
5,897,444 A * 4/1999 Hellyer ..... 473/417
5,916,045 A * 6/1999 Busch ..... 473/417

* cited by examiner

*Primary Examiner*—Mitra Aryanpour

(57) ABSTRACT

A baseball batting practice device includes a home plate having a center axle extending upright from the home plate, an elongate and radially extending bar having a first end defining a hole through which the center axle extends for the bar to be rotatable about the center axle on the home plate, a bi-directional ratchet mechanism including a toothed disc and a pawl member engageable with each other arranged between the home plate and the bar to allow for angular displacement of the bar with respect to the home plate and a stand mounted to the bar and extending upright therefrom to support a baseball on a top end thereof. The stand includes a slide movably received in a radially extending channel defined in the bar whereby the stand is linearly movable with respect to the center axle in a radial direction.

8 Claims, 3 Drawing Sheets

ROTARY BASEBALL BATTING PRACTICE DEVICE

BACKGROUND OF THE INVENTION

1. Field of the Invention

The present invention relates generally to a device for practicing batting of baseball, and in particular to a rotary baseball batting practice device wherein the angular location of a stand that supports a baseball to be batted can be changed by means of rotation about a center under the control of a bi-directional ratchet mechanism.

2. The Related Art

Baseball batting practice devices are known. The baseball batting practice device comprises an upright holder that is rotatably mounted to a home plate for supporting and positioning a baseball. The upright holder is selectively retained at different discrete angular positions by means of a rotation mechanism. Such a rotatable construction of the baseball holder allows a player to selectively set a baseball supported by the holder at different angular positions. However, the holder is set at an angular position by having a spring-biased pin removably fit into angularly discrete retention holes defined in the home plate. The operation of moving the holder between different retention holes requires both hands of a user wherein one hand releases the pin and holds the pin in the released condition against the biasing spring and the other hand moves the baseball holder with the pin disengaging from the retention holes. This is very troublesome for the player for he or she must put down the bat before he or she can operate and move the baseball holder.

Thus, it is desired to have a baseball batting practice device that allows for one hand operation to overcome the problems encountered in the prior art.

SUMMARY OF THE INVENTION

Therefore, a primary objective of the present invention is to provide a baseball batting practice device that allows for single hand operation to selectively positioning a baseball to be batted at different angular locations by means of a bi-directional ratchet mechanism.

Another objective of the present invention is to provide a baseball batting practice device that allows for selectively positioning a baseball to be batted at different angular positions and further allows for selectively setting the baseball at different positions along a radial direction in a secured manner.

To achieve the above objectives, in accordance with the present invention, there is provided rotary baseball batting practice device comprising a home plate having a center axle extending upright from the home plate. An elongate, radially extending bar has a first end defining a hole through which the center axle extends whereby the bar is rotatable about the center axle on the home plate. A bi-directional ratchet mechanism including a toothed disc and a pawl member engageable with each other is arranged between the home plate and the bar to allow for angular displacement of the bar with respect to the home plate. A stand is mounted to the bar and extends upright from the bar to support a baseball on a top end thereof. The stand comprises a slide movably received in a radially extending channel defined in the bar whereby the stand is linearly movable with respect to the center axle in a radial direction.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
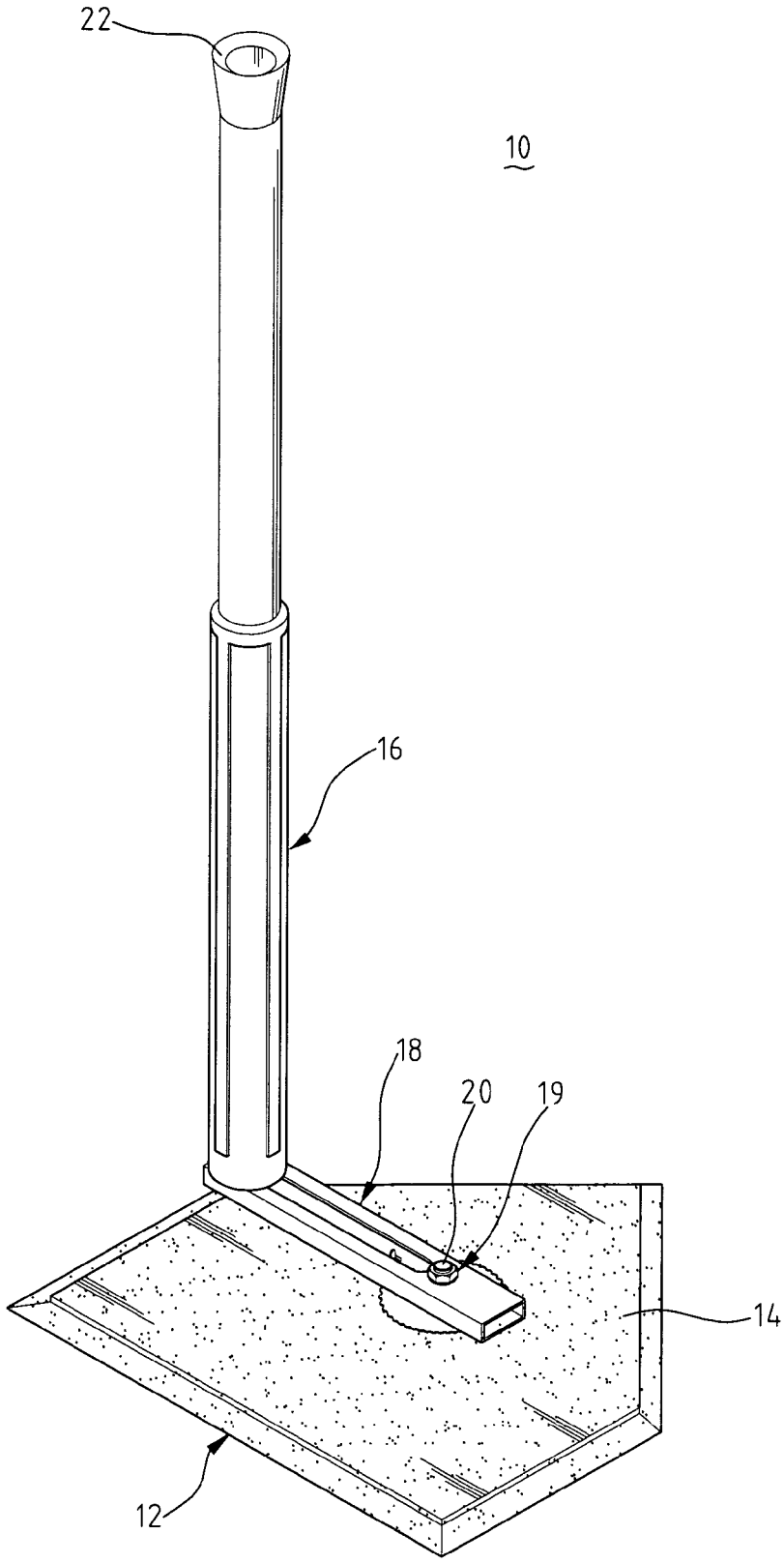
FIG. 1 is a perspective view of a baseball batting practice device constructed in accordance with the present invention.

With reference to the drawings and in particular to FIG. 1, a baseball batting practice device constructed in accordance with the present invention, generally designated with reference numeral 10, comprises a home plate 12 positionable on for example the ground of a practice field. The home plate 12 has a top face 14 on which an upright stand 16 is rotatably mounted by a rotary mechanism 18 whereby the stand 16 can be selectively moved from an initial position (shown in solid lines in FIG. 3) to any desired destination position (shown in phantom lines in FIG. 3) by rotation about a center axle 20 of the rotary mechanism 18. The stand 16 has a lower end mounted to the rotary mechanism 18 and an opposite upper end forming a conical cavity 22 for receiving and supporting a baseball (not shown) therein.

Figure 2:
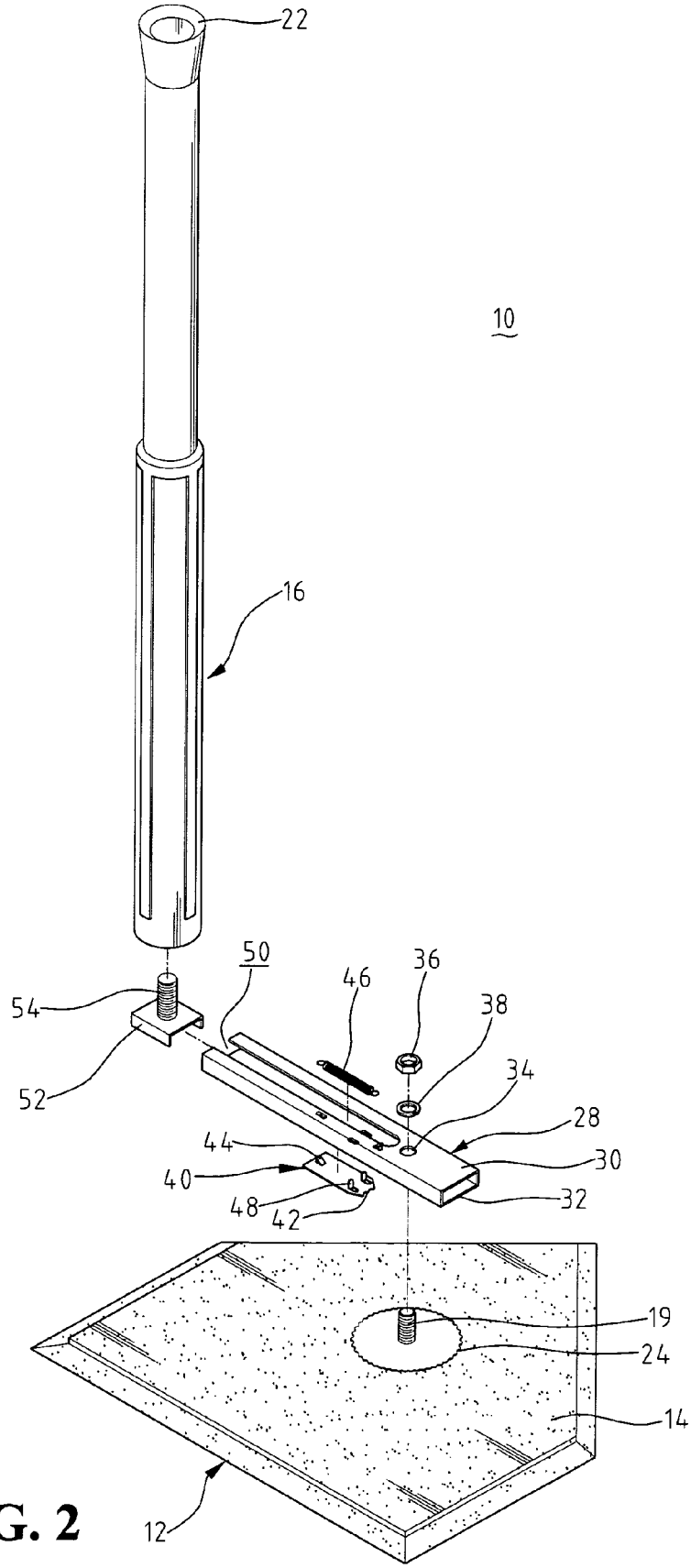
FIG. 2 is an exploded view of the baseball batting practice device of the present invention.

Also referring to FIG. 2, the rotary mechanism 18 comprises a tooted disc 24 fixed to the top face 14 of the home plate 12 by any known means. A threaded rod 19, serving as the center axle 20 of the rotary mechanism 18, vertically extends through the home plate 12 and a center of the disc 24. An elongate channel bar 28 has top and bottom walls 30, 32. Aligned holes 34 are defined in the top and bottom walk 30, 32 of the bar 28 at a location close to an inner end of the bar 28. The threaded rod 19 extends through the holes 34 and engages a nut 36 thereby securing the bar 28 to the home plate 14 with the bottom wall 32 of the bar opposing the top face 14 of the home plate 12 and the bar 28 being allowed to rotate about the threaded rod 19. Preferably, a washer 38 is interposed between the nut 36 and the top wall 30 of the bar 28. Thus, the bar 28 extends radially with respect to the center axle 20.

A pawl member 40 in the form of a plate having an inner end forming teeth 42 engageable with the teeth of the toothed disc 24 is interposed between the bottom wall 32 of the bar 28 and the top face 14 of the home plate 12. The pawl member 40 has a lug 44 to which an end of a resilient member 46, such as a helical spring, is attached. An opposite end of the resilient member 46 is attached to a suitable position on the bar 28. Thus, the resilient member 46 provides a spring force biasing the pawl member 40 toward the toothed disc 24 and thus facilitating the toothed engagement between the pawl member 40 and the toothed disc 24. The pawl member 40 and the toothed disc 24 with the spring 46 acting therebetween form a bi-directional ratchet mechanism, which allows the bar 28 to rotate in both clockwise and counterclockwise directions, while being selectively set at any desired angular position by having the teeth 42 of the pawl member 40 engaging teeth of the toothed plate 24 at corresponding position. The ratchet mechanism allows for a single hand operation for angularly moving the bar 28.

Preferably, the pawl member 40 has guide tabs 48 movably received in guide slits (not shown) defined in the bottom wall 32 of the bar 28 for guiding the relative movement of the pawl member 40 with respect to the bar 28.

An elongate slot 50 is defined in the top wall 30 of the bar 28 and has an opening (not labeled) at a remote end of the bar 28. A slide 52 is movably received in the channel bar 28. A threaded rod 54 extends from the slide 52 through the slot 50 in a movable manner. An inner threaded hole (not shown) is defined in the lower end of the stand 16 to threadingly engage the threaded rod 54 thereby securing the stand 16 to the bar 28. The threading engagement allows the stand 16 to securely attach to the slide 52 with opposite banks of the slot 50 interposed therebetween. Thus, the friction between the banks of the slot 50 and the slide 52 and the lower end of the stand 16 helps to securely fix the stand 22 to the bar 28, while allowing selectively moving the slide 52 and the stand 16 to any desired radial position along the slot 50 of the bar 28 by loosening the threading engagement between the stand 16 and the slide 52.

Figure 3:
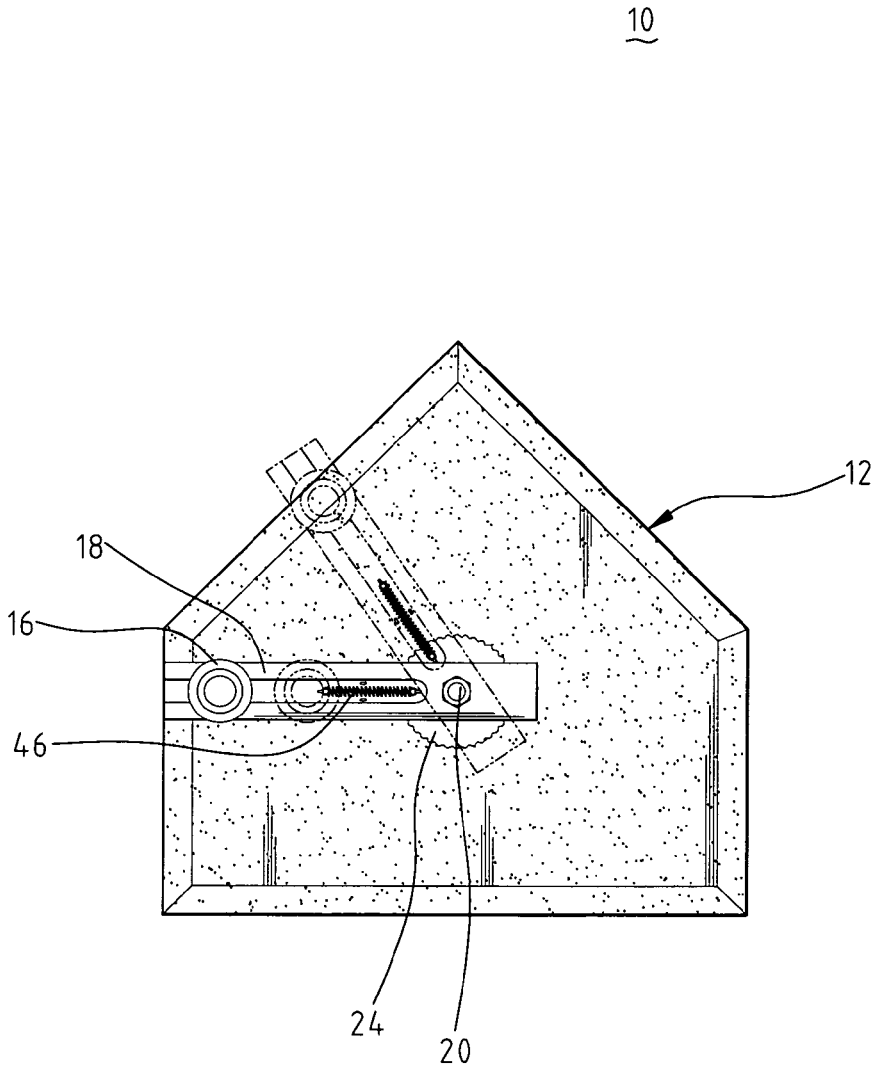
FIG. 3 is a top plan view of the baseball batting practice device of the present invention in which phantom lines show a destination angular position to which a stand that supports a baseball thereon is to moved from an initial angular position shown in solid lines.

Also referring to FIG. 3, to change the angular position of the stand 16 and thus the baseball (not shown) supported thereon, one simply holds the stand 16 (or alternatively, the bar 28) and rotates about the center axle 20 with a sufficient torque so as to overcome the resilient engagement between the pawl member 40 and the toothed disc 24. Thus, the engagement between the pawl member 40 and the toothed disc 24 is broken and the stand 16 is free of constraint in angular displacement. One advances the stand 16 as far as one wishes from an initial or current position (shown in solid lines in FIG. 3) to any desired destination position (shown in phantom lines) along the center axle 20. The biasing force of the resilient member 46 automatically re-assumes the engagement between pawl member 40 and the toothed disc 24 thereby securely retaining the stand 16 at the desired angular position.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A baseball batting practice device comprising:

a base plate having a top face and a center axle extending upright beyond the top face;

a toothed disc mounted to the top face of the base plate and concentric with the center axle;

an elongate bar having a first end rotatably mounted to the center axle and a second end distant from the center axle;

a pawl member movably mounted to the bar and having teeth formed on an end thereby, the pawl member being biased by a resilient member to have the teeth thereof engaging the toothed disc; and an upright stand mounted to the bar and forming a receptacle adapted to receive and support a baseball therein for being batted by a player.

2. The baseball batting practice device as claimed in claim 1, wherein the resilient member comprises a helical spring having opposite ends respectively attached to the bar and the pawl member to provide a biasing force therebetween.

3. The baseball batting practice device as claimed in claim 1, wherein the center axle comprises a threaded rod extending through a hole defined in the first end of the bar and engaging a nut to secure the bar on the base plate while allowing for rotation of the bar with respect to the base plate about the center axle.

4. The baseball batting practice device as claimed in claim 3 further comprising a washer interposed between the bar and the nut.

5. The baseball batting practice device as claimed in claim 1, wherein the baseball receptacle of the stand comprises a conical cavity defined in an upper end of the stand.

6. The baseball batting practice device as claimed in claim 1, wherein the bar has a bottom wall in which slits are defined to movably receive guide tabs formed on the pawl member for guiding the movement of the pawl member with respect to the bar.

7. The baseball batting practice device as claimed in claim 1, wherein the bar comprises a channel member having a top wall in which an elongate slot is defined and forming an opening at the second end of the bar, a slide being movably received in the channel and having a threaded rod extending therefrom through the slot in a movable manner, the stand having a lower end in which an inner-threaded hole is defined to engage the threaded rod of the slide whereby the stand is allowed to be linearly displaceable with respect to the center axle in a radial direction.

8. The baseball batting practice device as claimed in claim 1, wherein the base plate comprises a home plate.

* * * * *